US007213998B2

(12) United States Patent
Hay

(10) Patent No.: US 7,213,998 B2
(45) Date of Patent: May 8, 2007

(54) WATER-SUPPLYING CLEANING HEAD

(75) Inventor: Christopher James Mccaughan Hay, Hong Kong (HK)

(73) Assignee: Hayco Manufacturing Limited, Causeway Bay (HK)

( * ) Notice: Subject to any disclaimer, the term of this patent is extended or adjusted under 35 U.S.C. 154(b) by 381 days.

(21) Appl. No.: 10/894,960

(22) Filed: Jul. 20, 2004

(65) Prior Publication Data

US 2006/0018705 A1 Jan. 26, 2006

(51) Int. Cl.
*A46B 11/06* (2006.01)
*A47L 13/22* (2006.01)

(52) U.S. Cl. ..... 401/289; 401/203; 401/266; 401/268; 401/288; 15/221; 4/115; 4/132

(58) Field of Classification Search ..... 401/136, 401/203, 266, 268, 285, 288, 289, 291; 15/221; D4/115, 132
See application file for complete search history.

(56) References Cited

U.S. PATENT DOCUMENTS

| | | | | |
|---|---|---|---|---|
| 1,523,823 | A * | 1/1925 | Matta | 401/285 |
| 4,311,404 | A * | 1/1982 | Kodera | 401/289 |
| 5,702,195 | A * | 12/1997 | Rittenbaum | 401/289 |
| 5,885,019 | A * | 3/1999 | Stear | 401/289 |

* cited by examiner

*Primary Examiner*—Tuan Nguyen
(74) *Attorney, Agent, or Firm*—Barnes & Thornburg LLP

(57) ABSTRACT

A water-supplying cleaning head has a block (4) carrying a cleaning means such as bristles or an abrasive surface on the underside thereof, a threaded coupling (6) for connecting a water-supplying handle thereto and with an internal water-supplying bore defined from the coupling (6) to the underside of the block (4), a resilient connecting neck portion (10) provided between the block (4) and coupling (61) allowing limited relative movement therebetween.

11 Claims, 2 Drawing Sheets

WATER-SUPPLYING CLEANING HEAD

The present invention relates to a cleaning head, typically although not exclusively a brush head, which is adapted to have a source of water connected thereto.

Such "water brushes" typically have a hose connected thereto and are used in a wide variety of applications such is in the home for cleaning windows, cars, bicycles and a whole host of other items where it is desirable to have a continuous supply of water passing over the object as it is being cleaned, so as to improve the efficiency of cleaning.

Such water brushes usually comprise a rigid head or block which carries a plurality of bristles and a neck fitting having an adaptation to allow a hollow handle to be connected thereto. The head is formed with an internal bore or bores opening out onto a lower surface of the brush whereby the water can flow down the handle, through the neck onto the bristles and the object being cleaned.

The present invention is a development of this construction to allow an improved cleaning effectiveness.

SUMMARY OF THE INVENTION

According to a first aspect of the invention there is provided a water-supplying cleaning head comprising: a block; cleaning means on an underside of the block; a coupling for connecting a handle thereto; a flexible connecting portion between the block and coupling allowing limited relative movement therebetween, and a water-supplying bore defined from the coupling to the underside of the block.

The provision of this flexible connection significantly enhances the effectiveness of the cleaning head especially when used to clean non-planar surfaces, whereby the underside of the block is able to follow the surface which is being cleaned as the head is moved over the surface.

Preferably, the flexible connecting portion is formed of a resilient material, such as an elastomer. This is preferably overmoulded onto both the block and coupling. Both block and coupling may be formed with adaptations to maximise the anchoring of the overmoulded elastomer, in particular the coupling being provided with a tubular portion which extends into and is overlain by a portion of the flexible connecting portion. The block may be formed with an upstanding flange extending into the flexible connecting portion.

In the preferred embodiment the underside of the block is formed with an elongate channel in communication with said bore into which is fitted a member defining a plurality of water-supplying openings. The coupling has an internal thread for receiving a handle.

The cleaning means on the block underside may comprise bristles, or alternatively an abrasive pad, or wire wool pad or sponge or similar, or a combination thereof.

In a further aspect the invention resides in a water-supplying cleaning head as defined above in combination with a hollow water-supplying handle fitted to said coupling.

BRIEF INTRODUCTION TO THE DRAWINGS

An embodiment of the present invention is now described, by way of example only, with reference to the following drawings in which.

DETAILED DESCRIPTION OF THE PREFERRED EMBODIMENT

Figure 1:
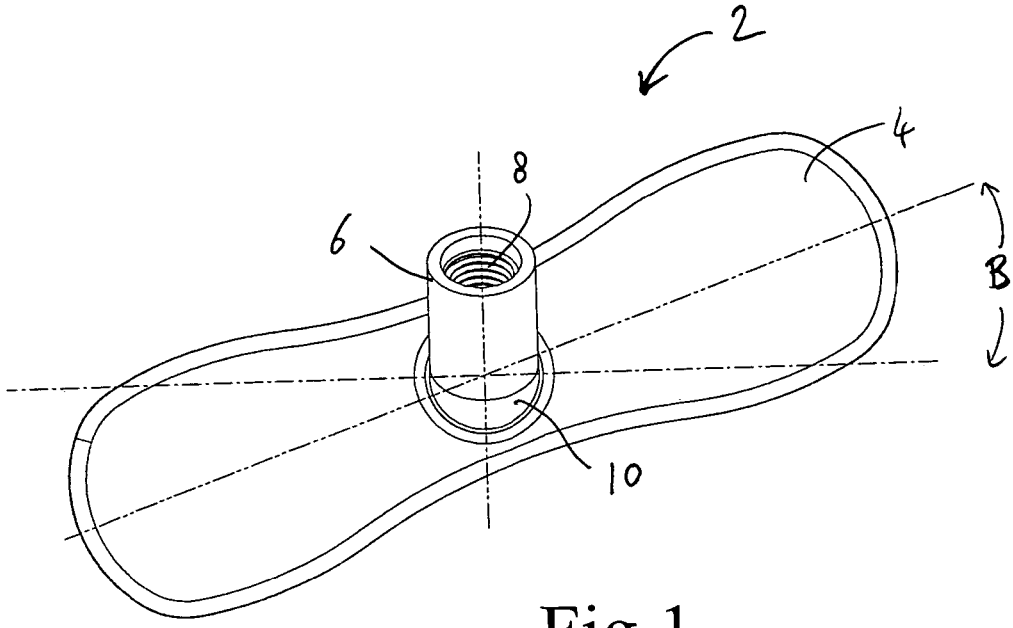
FIG. 1 shows an embodiment of the cleaning head of the invention being a water brush, from above.

Turning to the drawings, FIG. 1 shows a perspective view of the cleaning head in the form of a water brush head from above, generally indicated 2, comprising an elongate block 4 of slightly waisted design. The brush head 2 is provided with a coupling member 6 by which the brush head 2 has a handle fitted thereto, by means of an internal female screw thread 8 adapted to receive a complementary male thread of a handle (not shown). The axis of the coupling member 6 is inclined to the general plane of the block 4 by an angle of about 40°.

The coupling member 6 is connected to the block 4 through a flexible connection or neck 10 formed of a resilient material such as an elastomer allowing a degree of relative movement between the coupling 6 and the block 4.

An internal bore 11 is defined extending from the coupling 6 through the neck 10 and block 4 to the underside of the block 4.

Figure 2:
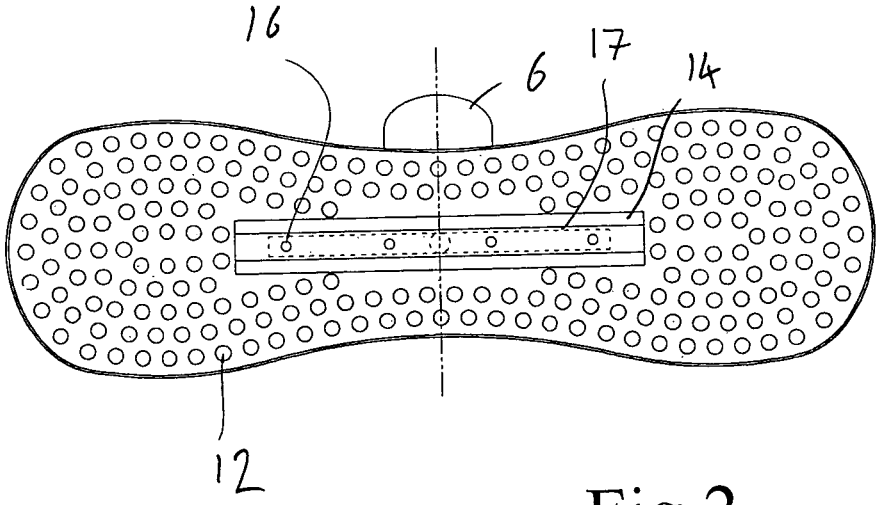
FIG. 2 shows the water brush from below.
Figure 3:
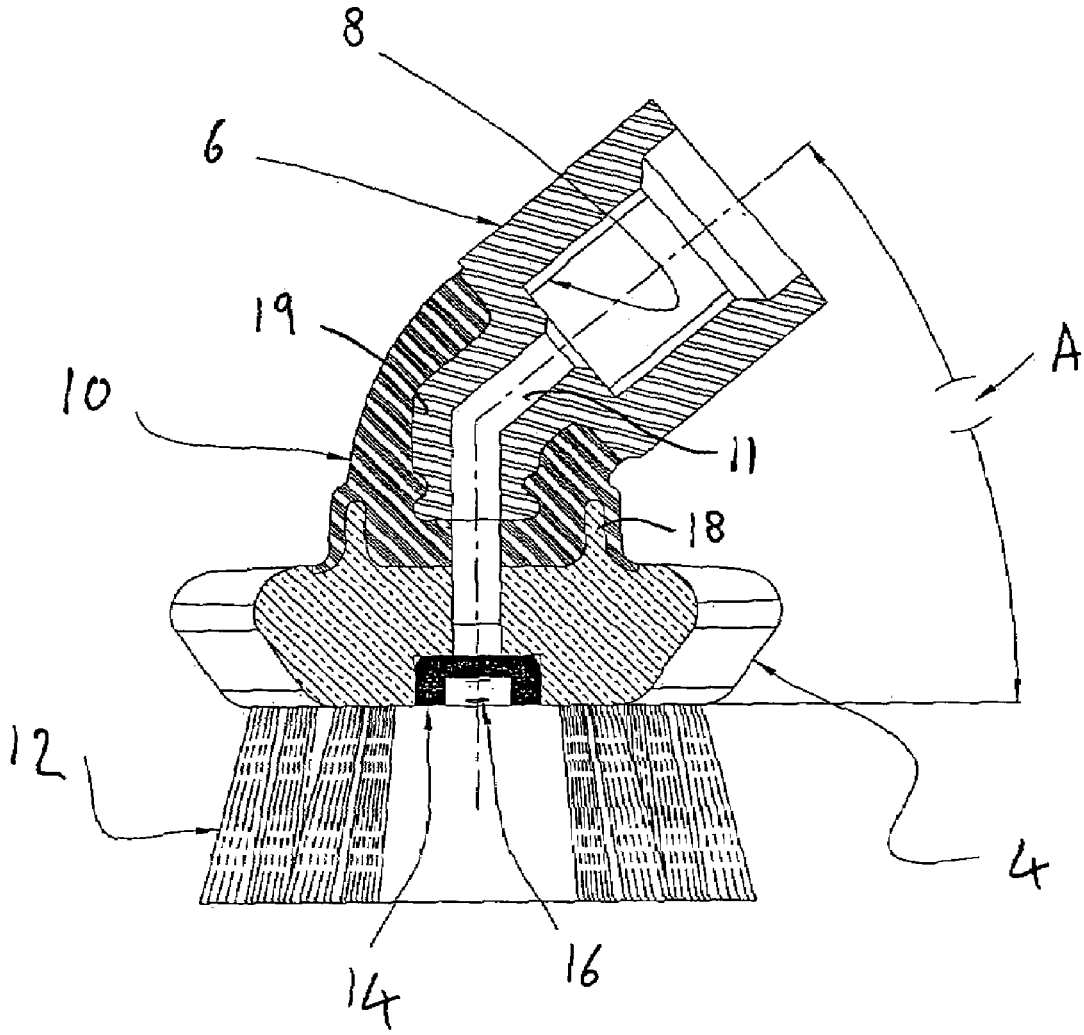
FIG. 3 is a lateral cross-section through the water brush.

The underside of the block 4 is provided with a plurality of bristles 12 which are fitted to the block in clumps in a known manner. Disposed generally centrally of the underside of the block 4 is an elongate channel into which is fitted a spray bar 14, being an elongate member of U-shaped section having a series of nozzle openings 16 spaced along its length, and with an internal channel-like enclosure 17 defined behind the spray bar 14, the outline of which is shown in dotted lines in FIG. 2. As can be seen in FIGS. 2 and 3 the central region around the spray bar is devoid of bristles.

The block 4 and coupling 6 are formed of a rigid material preferably a rigid plastics material such as nylon or polypropylene. The elastomeric neck 10 is ideally overmoulded onto both the block 4 and coupling 6. To enhance the interconnection the block 4 may be provided with an upstanding flange 18 which serves to improve the anchoring of the neck 10 thereto. It will also be seen in FIG. 3 that the coupling 6 is formed with a lower protruding tubular portion 19 over which the neck 10 is moulded. A lower end of this tubular portion 19 has a circumferential groove 20, further enhancing the anchoring of the neck material thereto. The properties of the elastomer constituting the neck 10 are selected such that a reasonable degree of rigidity of the connection is maintained for example to allow hard scrubbing of stubborn dirt, whilst still allowing some limited relative movement to allow the brush head 2 to follow in some manner curved surfaces being cleaned. The elastomer might be one of a variety of different materials, a preferred material being a thermoplastic resin having a hardness between about 20 to 40 Shore A.

Moreover, the specific shape of the neck 10 having a relatively small amount of resilient material on the inside region of the bend (ie the right hand side of FIG. 3) means that the connection allows only a relative small amount of movement in the directions indicated "A" in FIG. 3. On the other hand a relatively large amount of torsional movement, as indicated by "B" in FIG. 1 is allowed, typically up to about 15° in average use. This torsional freedom but restriction to bending is further enhanced by the extension of the tubular portion 19 into the flange 18.

Although the invention is illustrated and described with reference to a brush head having a plurality of bristles, the cleaning head could equally having a variety of other cleaning means fitted such as abrasive scrubbing pads or wire pads or sponges or a squeegee blade, or indeed a combination thereof.

The invention claimed is:

1. A water-supplying cleaning head comprising:

a block;

cleaning means on an underside of the block;

a coupling for connecting a handle thereto;

a flexible connecting portion having a different material than that of the block and coupling and molded between the block and coupling allowing limited relative movement therebetween, and a water-supplying bore defined from the coupling to the underside of the block.

2. A water-supplying cleaning head according to claim 1 wherein the flexible connecting portion is formed of a resilient material.

3. The water-supplying cleaning head according to claim 2 wherein the resilient material is an elastomer.

4. The water-supplying cleaning head according to claim 1 wherein the flexible connecting portion is overmolded onto the block and coupling.

5. The water-supplying cleaning head according to claim 1 wherein the coupling is provided with a tubular portion which extends into and is overlain by a portion of the flexible connecting portion.

6. The water-supplying cleaning head according to claim 1 wherein the block is formed with an upstanding flange extending into the flexible connecting portion.

7. The water-supplying cleaning head according to claim 1 wherein the underside of the block is formed with an elongate channel in communication with said bore into which is fitted a member defining a plurality of water-supplying openings.

8. The water-supplying cleaning head according to claim 1 wherein the coupling has an internal thread for receiving a handle.

9. The water-supplying cleaning head according to claim 1 wherein the cleaning means comprise a plurality of bristles.

10. The water-supplying cleaning head according to claim 1 wherein the cleaning means comprises an abrasive pad.

11. The water-supplying cleaning head according to claim 1 in combination with a hollow water-supplying handle fitted to said coupling.

* * * * *